US011031738B1

(12) United States Patent
Lin

(10) Patent No.: US 11,031,738 B1
(45) Date of Patent: Jun. 8, 2021

(54) MULTIPLE SOCKET PANEL DEVICE WITH ANTI-CROSSTALK SHIELDING STRUCTURE

(71) Applicant: Jyh Eng Technology Co., Ltd., New Taipei (TW)

(72) Inventor: Yen-Lin Lin, New Taipei (TW)

(73) Assignee: JYH ENG TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 16/733,578

(22) Filed: Jan. 3, 2020

(51) Int. Cl.

| | |
|---|---|
| ***H01R 13/60*** | (2006.01) |
| ***H01R 13/659*** | (2011.01) |
| ***H01R 13/74*** | (2006.01) |
| ***H01R 12/58*** | (2011.01) |
| ***H01R 13/514*** | (2006.01) |

(52) U.S. Cl.
CPC ..... *H01R 13/659* (2013.01); *H01R 12/58* (2013.01); *H01R 13/514* (2013.01); *H01R 13/74* (2013.01)

(58) Field of Classification Search
CPC ..... H01R 13/659; H01R 12/58; H01R 24/62
USPC ..... 439/540.1, 676
See application file for complete search history.

(56) References Cited

U.S. PATENT DOCUMENTS 4,756,695 A * 7/1988 Lane ..... H01R 24/62 439/535
5,074,801 A * 12/1991 Siemon ..... H01R 31/02 439/188
5,106,325 A * 4/1992 Robinson ..... H01R 13/514 439/535
5,362,254 A * 11/1994 Siemon ..... G02B 6/3897 439/142
5,385,488 A * 1/1995 Clark ..... H01R 13/518 439/535
6,769,937 B1 * 8/2004 Roberts ..... H01R 24/64 439/676
7,038,554 B2 * 5/2006 Seefried ..... H05K 1/0228 333/24 C
7,153,168 B2 * 12/2006 Caveney ..... H01R 13/6464 439/676
7,288,001 B1 * 10/2007 Aekins ..... H01R 4/2429 439/540.1
7,878,824 B2 2/2011 Pepe et al.
8,052,482 B1 * 11/2011 Lin ..... H01R 13/6467 439/676

(Continued)

*Primary Examiner* — Neil Abrams
(74) *Attorney, Agent, or Firm* — Guice Patents PLLC

(57) ABSTRACT

A multi-socket panel device with an anti-crosstalk shielding structure mainly includes a main base body having an accommodation space inside, and a plurality of through slots are formed on the main base body and penetrate the main base plate. The device further includes a plurality of socket sets, which are correspondingly combined with the main base body. Each socket set further includes a base plate, and a plurality of prick type terminals are arranged on one surface of the base plate and pass through the base plate to another. On one surface of the substrate, a plurality of sockets are provided on the other surface of the substrate, and the corresponding sockets are inserted into the sockets. A plurality of wire terminals are provided at the bottom of the jack and extend to the outside of the sockets to form electrical connection with the prick type terminals. A shield sleeve base is connected to each socket. Each socket is protected by the shield sleeve to prevent crosstalk between the sockets.

13 Claims, 6 Drawing Sheets

(56) References Cited

U.S. PATENT DOCUMENTS

| | | | | |
|---|---|---|---|---|
| 8,162,692 | B2 * | 4/2012 | Siemon | H01R 13/6469 439/555 |
| 8,197,281 | B2 * | 6/2012 | Yang | H01R 12/725 439/499 |
| 8,632,362 | B2 * | 1/2014 | Straka | H01R 13/6473 439/607.38 |
| 8,758,047 | B2 * | 6/2014 | Dietz | H01R 13/514 439/540.1 |
| 9,118,134 | B2 * | 8/2015 | Babu | H01R 13/26 |
| 9,502,842 | B2 * | 11/2016 | Belopolsky | H01R 24/64 |
| 10,424,874 | B2 * | 9/2019 | Belopolsky | H01R 24/64 |

* cited by examiner

MULTIPLE SOCKET PANEL DEVICE WITH ANTI-CROSSTALK SHIELDING STRUCTURE

BACKGROUND OF THE INVENTION

Field of the Invention

The invention relates to a socket structure, and more particularly to a multiple socket panel device with anti-crosstalk shielding structure.

Description of the Related Art

In a typical network room, it is constructed by various network equipment installed in a cabinet, which includes switches, panels, jumpers, network cables and other equipment, thereby constructing systems and environments of network communications.

According to the international standard settings, the network system is divided into two types: shielded and non-shielded. In the setting of the shielded system, the shield structure must be used to isolate external interference, and the interference signal is guided by grounding. Therefore, there will be a ground wire or a braided net in the setting of the network line. In addition to the ground wire or braided net in the jumper, the connectors on both ends of the wire will also be provided with a shield structure, such as an iron sheet which is connected to the ground wire, and there will also be a ground wire on the panel, so that when the jumper is inserted into the panel, the grounding effect is continuous, thereby completing the shielding effect. On the contrary, the panel, the jumper and the network cable of the non-shielding system will not be provided with the shielding structure.

However, with the progress of the times, while the network frequency requirements are getting higher and higher, the relevant international specifications have also evolved, and the two systems also need to be upgraded. However, as the frequency increases, the crosstalk interference, the self-generated interference or the foreign interference, is relatively increased, especially the international standard has set the Alien crosstalk test standard. No matter the non-shielded system is on the wire or the panel, it will encounter the problem of external crosstalk interference.

In the conventional technology of the panel, an anti-external crosstalk structures for panel as disclosed in U.S. Pat. No. 7,288,001. The space shielding is used to cover non-adjacent signal contact groups with a shielding cover. Although the shielding method is used, it can still block the signals between adjacent signal contact groups. However, this method has the disadvantage that although it will not be affected by adjacent signal connections because there is no signal contact structure covered by the shielding cover, it may be interfered by the signals from other equipment, especially in the current situation where the equipment room equipment is arranged more and more closely.

Another anti-external crosstalk structures for panel as disclosed in U.S. Pat. No. 7,878,824. An isolation structure is added between multiple signal contact groups, such as a metal sheet, or the inner wall of the housing of the signal contact group is directly plated by metal to form an isolation layer. However, with a metal material as the separator, its structure is only set between the jacks, and it is not effective to isolate the external crosstalk from other directions. If the metal plating is used on the inner wall of the housing, in addition to the environmental pollution caused by metal plating, its cost is relatively high.

BRIEF SUMMARY OF THE INVENTION

In view of the above-mentioned shortcomings, the main object of the invention is to provide a multi-socket panel device with an anti-crosstalk shielding structure. A shield sleeve made of a metal material is set on the outside of the socket to prevent adjacent sockets crosstalk interference from all directions. In addition to effectively protecting external interference, this structure can also reduce production costs and production time.

The invention provides a multiple socket panel device with anti-crosstalk shielding structure, including a main base body having an accommodation space therein; a plurality of socket sets corresponding to the main base body, wherein each socket set further comprises: a substrate; a plurality of prick type terminals provided on both sides of a surface of the substrate, and the prick type terminals penetrate the substrate to the other surface; a plurality of sockets provided on the other surface of the substrate and combined to the main body, wherein each socket comprises a jack, and a plurality of wire terminals for electrical connection provided in the jack and connected with the plurality of prick type terminals provided on the substrate to form electrical conduction; a plurality of shielding sleeve bases connected to each socket, wherein the shielding sleeve bases are made of metal material; a back plate correspondingly combined with the main base body, and covers the socket sets and the shield sleeve.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
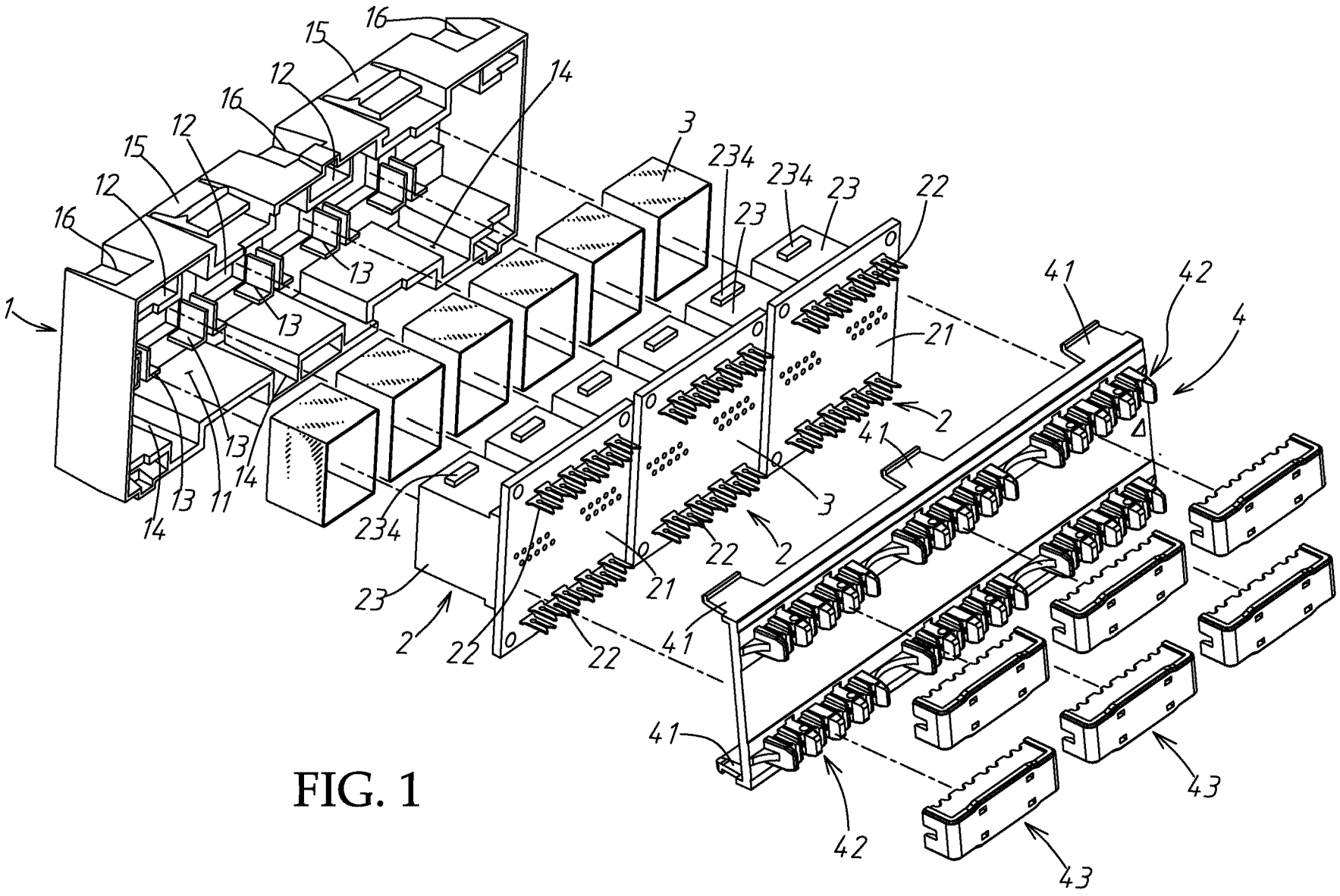
FIG. 1 is a perspective exploded view of the invention.

Referring to FIG. 1, which is a perspective exploded view of the invention. As shown in FIG. 1, the multi-socket panel device of the invention mainly includes a main base body 1, which is elongated, and the main base body 1 has an accommodation space 11 therein. The main base body 1 is provided with a plurality of through grooves 12 separated from each other and penetrating the plate surface of the main base body 1. The guide plates 13 are respectively arranged on the two sides of the main base body 1 in the accommodation space 11 and corresponding to the positions of the through grooves 12. The guide plates 13 are L-shaped. A plurality of sliding grooves 14 are provided at the bottom of the accommodating space 11 and corresponding to the positions of the through slots 12. A plurality of top plates 15 and a plurality of slots 16 are provided on the top of the main base body 1. The top plates 15 and the slots 16 are alternately arranged.

Referring to FIG. 1, the device further includes a plurality of socket sets 2, which are assembled to the main base body 1. Each socket set 2 further includes a substrate 21, which is rectangular. In this embodiment, the substrate 21 is a circuit board provided with a plurality of conductor circuits. A plurality of prick type terminals 22 are provided on two sides of one surface of the substrate 21, and the prick type terminals 22 penetrate the substrate 21 to the other surface. On the other surface of the substrate 21, a plurality of sockets 23 are respectively provided. In accordance with a partial enlarged view of the socket structure shown in FIG. 2. Each socket 23 has a jack 231, and the jack 231 is provided with a plurality of wire terminals 232 for electrical connection are connected to each other and extend on the substrate 21. The wire terminals 232 are connected to the plurality of prick type terminals 22 provided on the substrate 21 to form electrical conduction. A step portion 233 is formed on the top surface and the bottom surface of each socket 23, and a protrusion 234 is provided on the top surface of each socket 23.

Figure 2:
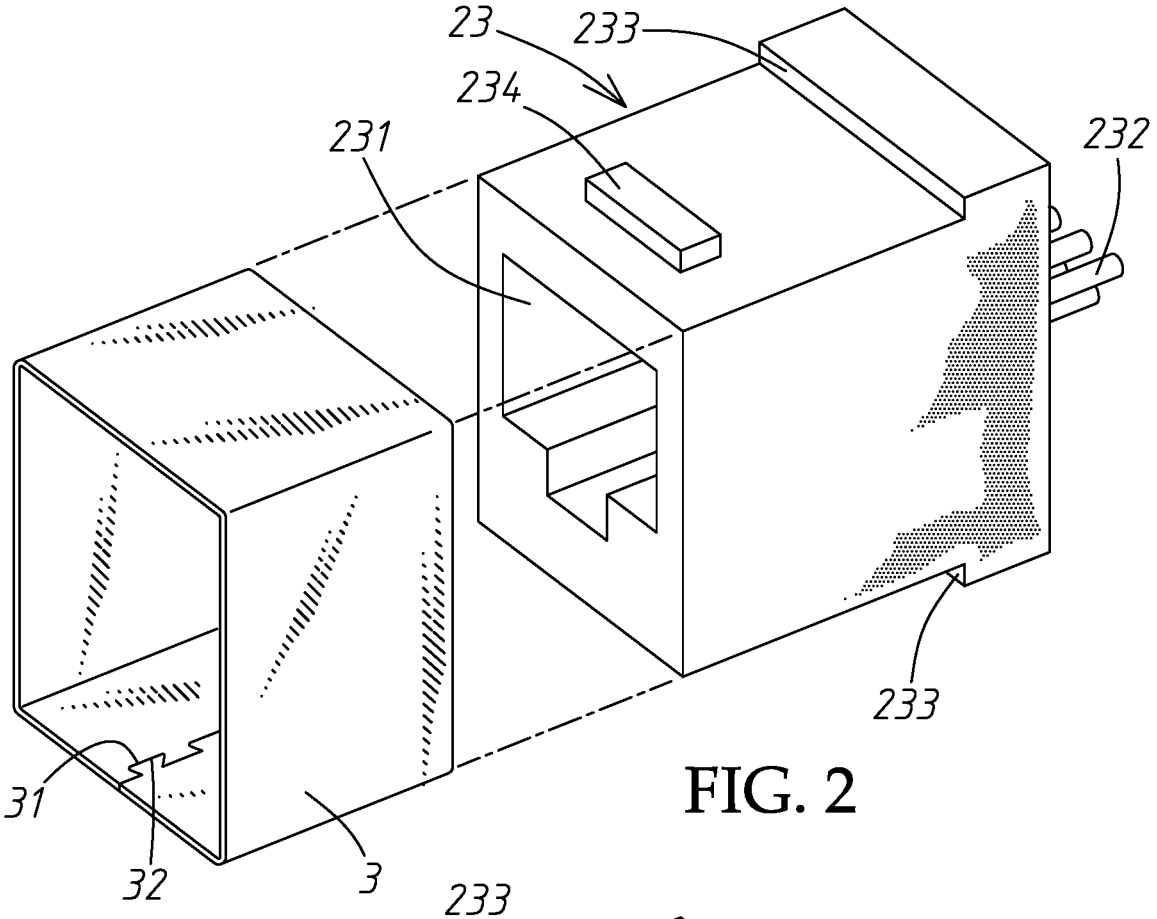
FIG. 2 is a partially enlarged view of a socket structure of the invention.
Figure 3:
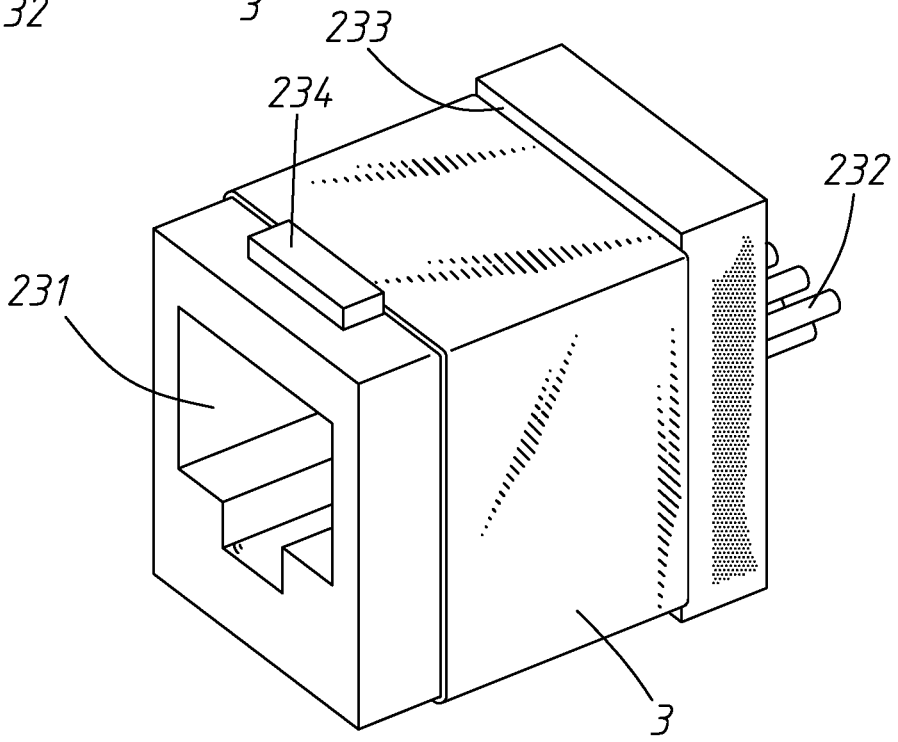
FIG. 3 is a partially assembled view of the invention.
Figure 4:
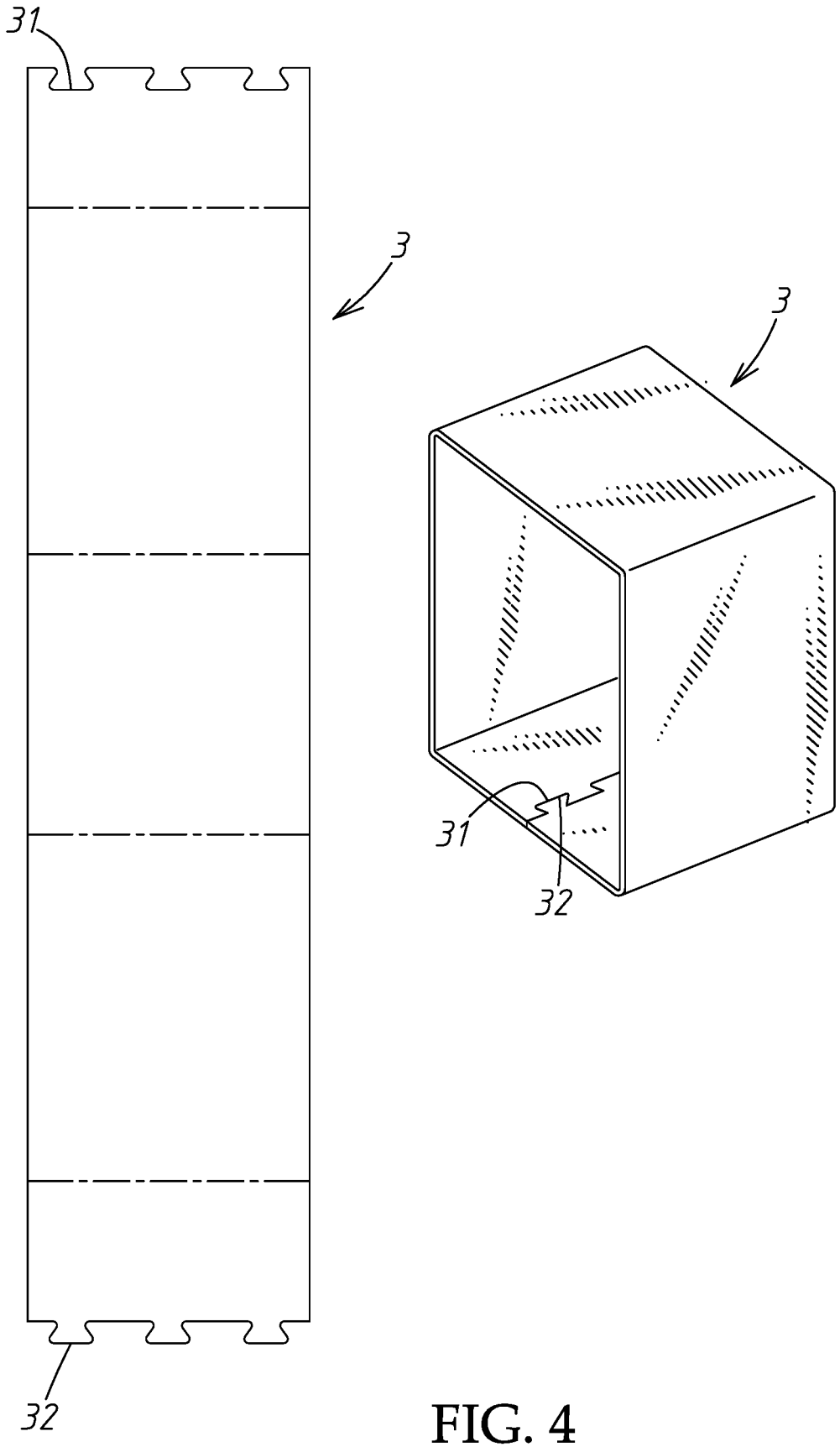
FIG. 4 is a partially enlarged view of shielding sleeve base of the invention.
Figure 5:
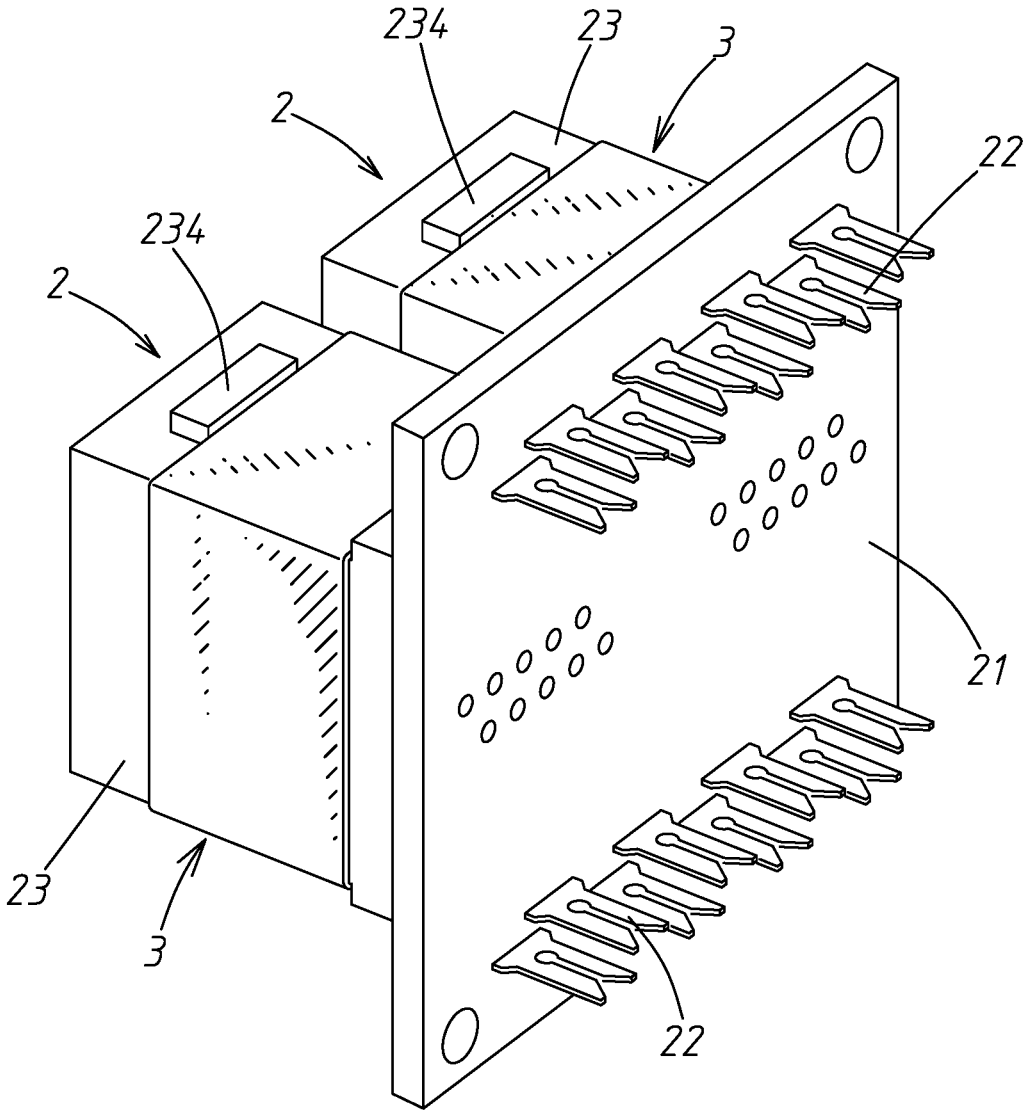
FIG. 5 a partially assembled view of a socket set of the invention.

Referring to FIG. 2, a shield sleeve 3 is connected to each of the sockets 23. The shield sleeve 3 is made of a metal material. As shown in a partially enlarged view of the shielding sleeve base structure in FIG. 4, the shield sleeve 3 is formed by bending a long plate body to form a rectangular hollow seat body. In this embodiment, two short sides of the long plate body are provided with a plurality of engaging slots 31 and a plurality of hooks 32. The engaging slots 31 and the hooks 32 are assembled with each other to maintain the shape of the shielding sleeve base 3. After the shielding sleeve base 3 is set on each corresponding socket 23, the shielding sleeve base 3 is engaged between the step portion 233 and the projection 234 of each socket 23 to maintain the relative position of the shielding sleeve base 3 on the socket 23, as shown in the partially assembled view of FIG. 3. the partially assembled figure of the socket set 2 and the socket sets of the shielding sleeve base 3 is shown as FIG. 5.

Referring to FIG. 1, the device further includes a back plate 4 which is correspondingly combined with the main base body 1 and covers the socket set 2 and the shielding sleeve base 3, wherein a plurality of engaging plates 41 are provided on the two long sides of the back plate 4. The engaging plates 41 are correspondingly inserted into the slots 16 of the main base body 1, thereby maintaining the relative position of the back plate 4 and the main base body 1. The outer surface of the back plate 4 is provided with a plurality of connection grooves 42. The connection grooves 42 are correspondingly connected to the prick type terminals 22 to form electrical conduction. Finally, the A plurality of protective covers 43 are combined to the positions corresponding to the connection grooves 42. The protective covers 43 are rectangular.

Figure 6:
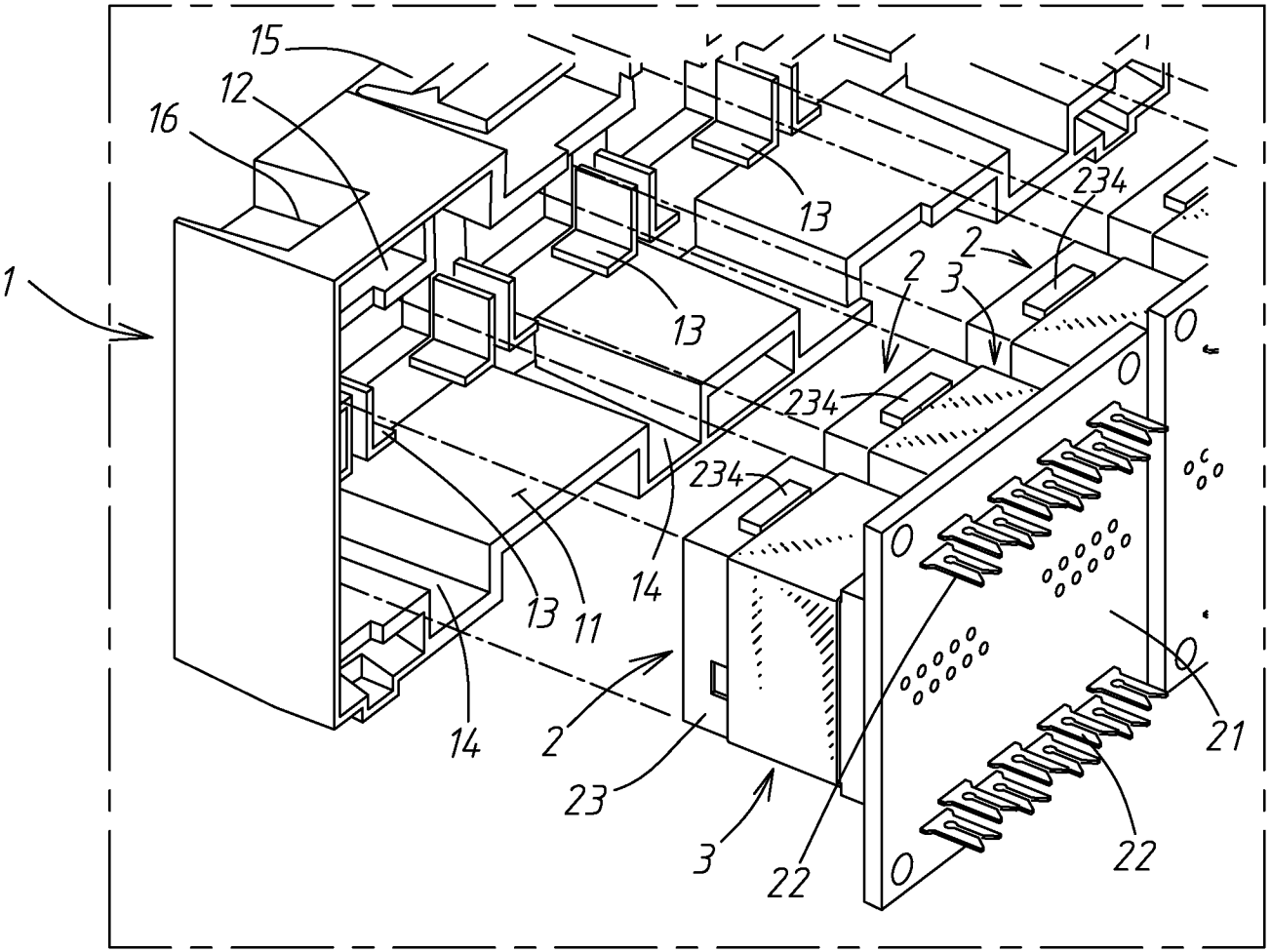
FIG. 6 is a schematic assembled view of the invention.

Finally, as shown in the assembly view of FIG. 6, the socket sets 2 are assembled in the accommodation space 11 corresponding to the main base body 1. Each socket 23. The guide is correspondingly inserted into the through slot 12 of the main base body 1 through the guide of the sliding grooves 14 and the guide plate 13, so that the jack 231 of each socket 23 is exposed on the other side of the main base body 1. Each socket 23 is protected by the shielding sleeve 3 to isolate crosstalk that may occur between the sockets 23 so as to keep the smooth network connection.

Figure 7:
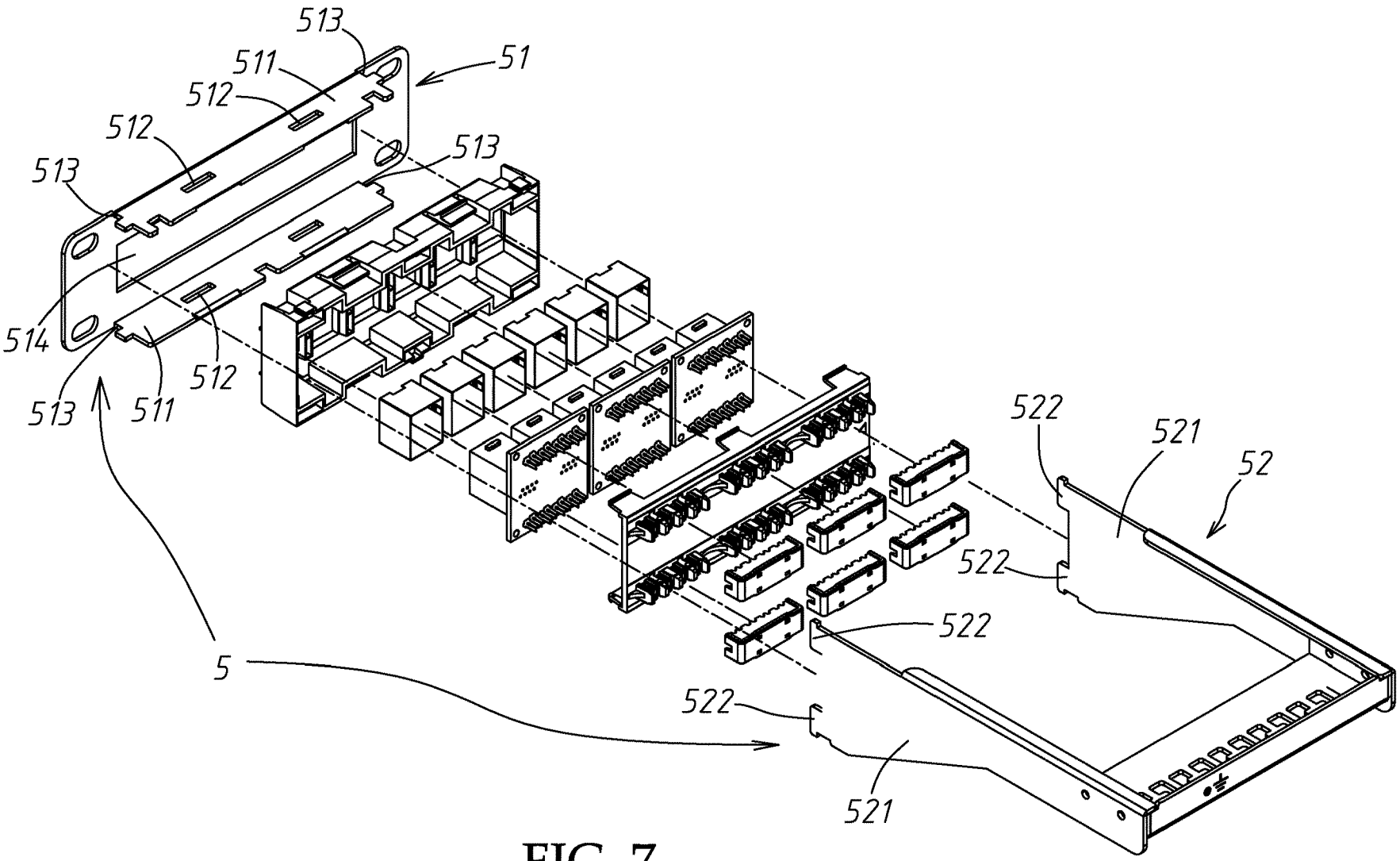
FIG. 7 is a exploded view of another embodiment of the invention.

Please referring to FIG. 7, which is an perspective exploded view of another embodiment of the present invention. As shown in FIG. 7, the device of the invention further includes a panel set 5. In this embodiment, the panel set 5 is used to fix a combination of a main base body 1, a socket set 2 and a back plate 4. The panel set 5 further includes a front plate base 51 and a bracket 52, wherein the front plate base 51 is correspondingly combined with the main base body 1. Two lateral plates 511 are provided on both sides of the front plate base 51 respectively, and a plurality of engaging holes 512 are provided on each of the lateral plates 511, whereby the front plate base 51 is combined with the main base body 1 correspondingly, and each of the engaging holes 512 correspondingly engages each top plate 15, thereby maintaining the relative position of the main base body 1 of the front plate base 51. In addition, A plurality of engaging grooves 513 are provided at the two ends of the front plate seat 51, and a rectangular opening 514 is formed on a surface of the front plate seat 51. The opening hole 514 corresponds to the main base body 1 to expose each socket set 2. The bracket 52, which is U-shaped, is connected to the front plate seat 51. The bracket 52 has connection brackets 521 on both sides, and each of the connection brackets 521 has a plurality of barbs 522 at the front end. The barbs 522 correspondingly engages with the engaging grooves 513 of the front plate base 51, thereby maintaining the relative positions of the front plate base 51 and the bracket 52.

In addition to the embodiment shown in FIG. 7, the panel set 5 can further fix a plurality of combinations of the main base body 1, the socket group 2 and the back plate 4, so that it can connect more related network equipment.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A multiple socket panel device with anti-crosstalk shielding structure, comprising:

a main base body having an accommodation space therein;

a plurality of socket sets corresponding to the main base body, wherein each socket set further comprises:

a substrate;

a plurality of prick type terminals provided on a surface of the substrate, and the prick type terminals penetrate the substrate to another surface of the substrate;

a plurality of sockets provided on the other surface of the substrate and combined to the main body, wherein each socket comprises a jack, and a plurality of wire terminals for electrical connection provided in the jack and connected with the plurality of prick type terminals provided on the substrate to form electrical conduction;

a plurality of shielding sleeve bases connected to each socket, wherein the shielding sleeve bases are made of metal material;

a back plate correspondingly combined with the main base body, and covers the socket sets and the shield sleeve;

wherein the main base body comprises a plurality of top plates and a plurality of slots provided on the top of the main base body, and the top plates and slots are alternately disposed.

2. The multiple socket panel device as claimed in claim 1, wherein a plurality of engaging boards provided on both long sides of the back plate, wherein the engaging boards are correspondingly inserted into the slots of the main base body, thereby fixing the relative positions of the back plate and the main base body.

3. The multiple socket panel device as claimed in claim 1, wherein a plurality of connecting grooves are provided on an outer surface of the back plate, and the connecting grooves are correspondingly connected to the prick type terminals, and a plurality of protective covers are correspondingly connected to the positions of the connecting grooves.

4. The multiple socket panel device as claimed in claim 1, wherein the substrate is a circuit board and is provided with a plurality of conductor circuits.

5. The multiple socket panel device as claimed in claim 1, wherein the shielding sleeve base is formed through bending a rectangular plate body to form a rectangular hollow base body.

6. The multiple socket panel device as claimed in claim 5, wherein a plurality of engaging slots and a plurality of hooks are provided on two short sides of the long plate body, and the engaging slots and the hooks are assembled with each other to maintain the shape of the shielding sleeve base.

7. The multiple socket panel device as claimed in claim 1, wherein a step portion is formed on a top surface and a bottom surface of each of the sockets, and a protrusion is provided on the top surface of each of the sockets.

8. The multiple socket panel device as claimed in claim 7, wherein when the shielding sleeve bases are sleeved on the corresponding sockets, the shielding sleeves are constrained between the step portions and the projections of the sockets to maintain the relative positions of the shielding sleeve bases on the sockets.

9. The multiple socket panel device as claimed in claim 1, wherein the main base body is provided with a plurality of through grooves separated from each other and penetrating the main base body plate surface, and a plurality of guide plates are provided in an accommodation space of the main base body and disposed in positions on both sides of the main base body corresponding to each of the through grooves, and a plurality of slide grooves are provided at a bottom of the accommodation space and disposed in positions corresponding to the through grooves.

10. The multiple socket panel device as claimed in claim 9, wherein the guide plates are L-shaped.

11. The multiple socket panel device as claimed in claim 9, wherein the plurality of sockets are assembled with the corresponding through slots.

12. The multiple socket panel device as claimed in claim 2, further comprising a panel set configured to fix a combination of at least one main base body, the socket set and the back plate, wherein the panel set further comprises:

a front plate seat correspondingly combined with the main seat body, each side of the front plate seat is provided with one lateral plate, and a plurality of engaging holes are provided on each side plate, so that each of the engaging holes engages each of the top plates when the front plate seat is correspondingly combined with the main seat body, a plurality of engaging grooves are provided at the two ends of the front plate seat and a opening which is rectangular is formed on a surface of the front plate seat, and the opening corresponds to the main seat to expose each of the socket sets;

a bracket connected to the front plate base and has a connecting frame on both sides thereof, and each of the connecting frames has a plurality of barbs at the front end, wherein the barbs engages the engaging grooves correspondingly.

13. The multiple socket panel device as claimed in claim 12, wherein the bracket is U-shaped.

* * * * *